United States Patent [19]

Van Ostrom

[11] 4,137,885

[45] Feb. 6, 1979

[54] DIESEL ENGINE GLOW PLUG ENERGIZATION CONTROL CIRCUIT

[75] Inventor: David L. Van Ostrom, Flint, Mich.

[73] Assignee: General Motors Corporation, Detroit, Mich.

[21] Appl. No.: 841,126

[22] Filed: Oct. 11, 1977

[51] Int. Cl.[2] ..... F02N 17/00

[52] U.S. Cl. ..... 123/179 H; 123/179 BG

[58] Field of Search ..... 123/179 B, 179 BG, 179 H

[56] References Cited

U.S. PATENT DOCUMENTS

| | | | |
|---|---|---|---|
| 3,371,656 | 3/1968 | Stouffer et al. | 123/179 H |
| 3,551,686 | 12/1970 | Koehler et al. | 123/179 H |
| 3,675,033 | 7/1972 | Richard et al. | 123/179 H |
| 3,708,683 | 1/1973 | Howland | 123/179 H |
| 4,075,998 | 2/1978 | Kraass et al. | 123/179 H |
| 4,088,109 | 5/1978 | Woodruff et al. | 123/179 H |

FOREIGN PATENT DOCUMENTS

| | | | |
|---|---|---|---|
| 1954630 | 5/1970 | Fed. Rep. of Germany | 123/179 H |
| 2205108 | 11/1972 | Fed. Rep. of Germany | 123/179 H |
| 2360841 | 6/1975 | Fed. Rep. of Germany | 123/179 H |
| 2300229 | 3/1976 | Fed. Rep. of Germany | 123/179 H |

*Primary Examiner*—Ronald H. Lazarus
*Assistant Examiner*—David D. Reynolds
*Attorney, Agent, or Firm*—Richard G. Stahr

[57] ABSTRACT

A glow plug temperature simulator circuit produces an electrical signal having a rate of increase of potential level substantially corresponding to the rate of increase of glow plug temperature and a rate of decrease of potential level substantially corresponding to the rate of decrease of glow plug temperature upon glow plug energization and subsequent deenergization, respectively. An electrical switching arrangement is effective to complete a glow plug energizing circuit across an operating potential source in response to the application of operating potential and, thereafter, is effective to alternately interrupt and complete the glow plug energizing circuit in response to the increase of the electrical signal to a predetermined potential level and in response to the decrease of the electrical signal to another lower predetermined potential level, respectively, to cyclically complete and interrupt the glow plug energizing circuit.

10 Claims, 3 Drawing Figures

DIESEL ENGINE GLOW PLUG ENERGIZATION CONTROL CIRCUIT

Figure 1:
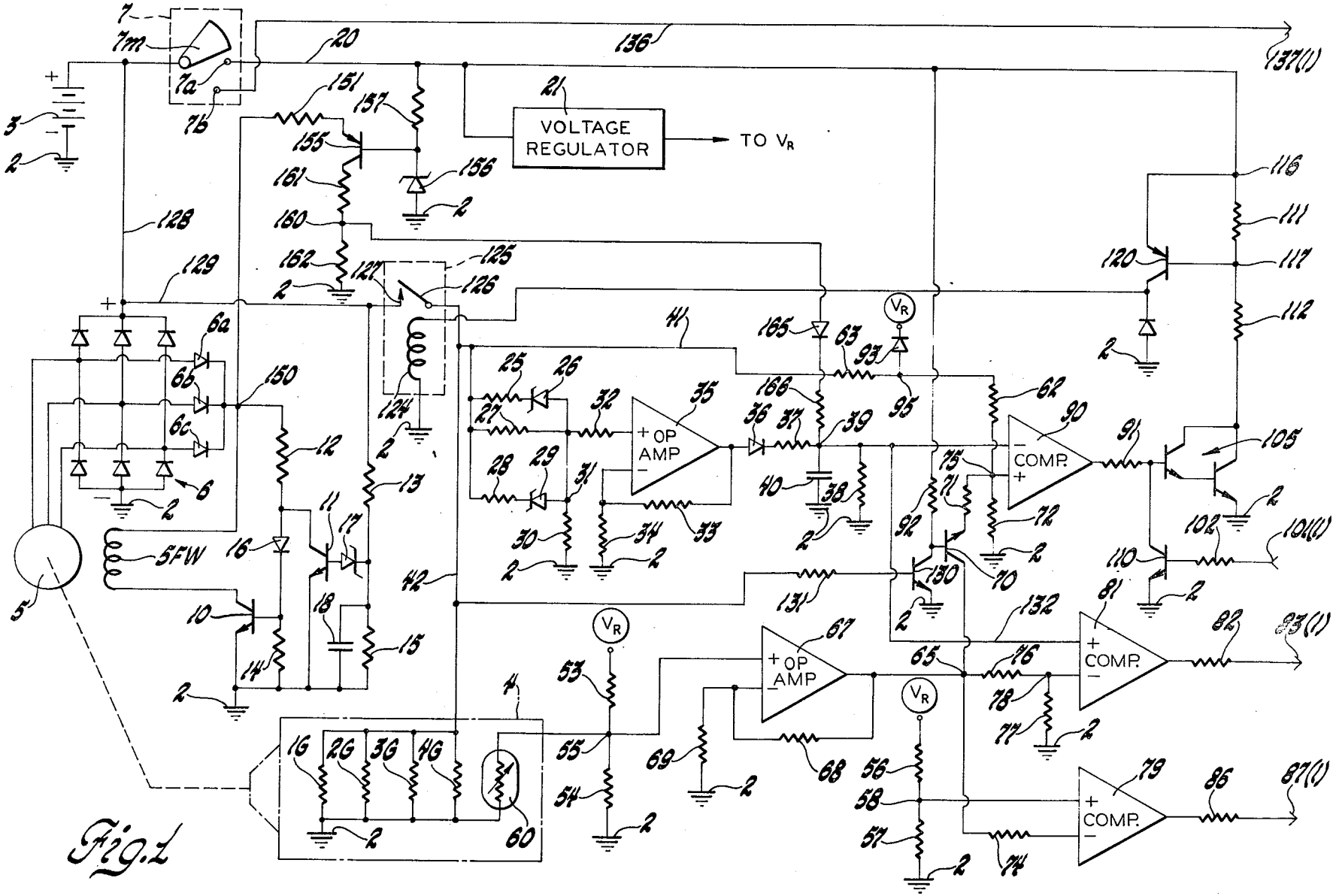

This invention is directed to a Diesel engine glow plug energization control circuit and, more specifically, to a Diesel engine glow plug energization control circuit which cyclically completes and interrupts a glow plug energizing circuit in response to the increase of an electrical signal having an instantaneous potential level indicative of glow plug temperature at that instant to a predetermined potential level and in response to the decrease of the electrical signal to another lower predetermined potential level, repsectively.

To facilitate Diesel engine starting, especially with cold ambient temperatures, electrically energized glow plugs which may be threaded into the engine block and include heater elements in communication with the combustion chamber are generally employed. Upon the electrical energization thereof, the heater elements are raised in temperature to preheat the combustion chamber prior to engine "Crank". The period of time of glow plug heater element energization prior to engine "Crank", the preheat period, is determined by engine temperature and glow plug heater element energizing potential magnitude, the lower the engine temperature and/or the lower the energizing potential magnitude, the longer the period of glow plug heater element energization required. In prior art glow plug energization control systems, the glow plug heater elements are energized at rated energizing potential. Although this rated potential glow plug heater element energization prevents premature failure as a result of overheating, the period of preheat before engine "Crank" may be of the order of one or two minutes or more with colder ambient temperatures. To substantially reduce the period of preheat, the glow plug heater elements may be energized at greater than rated energizing potential. With glow plug heater element energization that is greater than rated potential, however, it is necessary that the heater elements be cyclically energized for successive periods of time just long enough to increase the temperature thereof to a predetermined maximum. Therefore, a Diesel engine glow plug energization control circuit which provides for a substantial reduction of the period of preheat before engine "Crank" by cyclically completing and interrupting the glow plug heater element energizing circuit through which the glow plug heater elements are energized at greater than rated operating potential, is desirable.

It is, therefore, an object of this invention to provide an improved Diesel engine glow plug energization control circuit.

It is another object of this invention to provide an improved Diesel engine glow plug energization control circuit which substantially reduces the preheat period by cyclically completing and interrupting the glow plug heater element energizing circuit through which the heater elements are energized at greater than rated potential.

It is another object of this invention to provide an improved Diesel engine glow plug energization control circuit wherein the combination of glow plug temperature simulator circuitry that produces an electrical signal having an instantaneous potential level indicative of glow plug temperature at that instant and switching circuitry responsive to this electrical signal is effective to complete a glow plug energizing circuit across an operating potential source in response to the application of operating potential and, thereafter, is effective to cyclically interrupt and complete the glow plug energizing circuit.

It is another object of this invention to provide an improved Diesel engine glow plug energization control circuit which cyclically completes and interrupts a glow plug energizing circuit in response to an electrical signal having a rate of increase of potential level substantially corresponding to the rate of increase of glow plug temperature and a rate of decrease of potential level substantially corresponding to the rate of decrease of glow plug temperature upon glow plug energization and subsequent deenergization, respectively.

It is a further object of this invention to provide an improved Diesel engine glow plug energization control circuit which cyclically completes and interrupts a glow plug energizing circuit in response to an electrical signal having a rate of increase of potential level substantialy corresponding to the rate of increase of glow plug temperature and a rate of decrease of potential level substantially corresponding to the rate of decrease of glow plug temperature upon glow plug energization and subsequent deenergization, respectively, and includes circuitry for preventing the electrical signal from decreasing in potential level below a predetermined potential level indicative of glow plug temperature as a result of engine heat of combustion.

In accordance with this invention, a Diesel engine glow plug energization control circuit for use with Diesel engines having at least one glow plug is provided wherein electrically operable switching circuitry is effective to complete a glow plug energizing circuit across an operating potential source in response to the application of operating potential and, thereafter, is effective to cyclically interrupt and complete the glow plug energizing circuit in response to the increase of an electrical signal having an instantaneous potential level indicative of glow plug temperature at that instant to a predetermined potential level and in response to the decrease of this electrical signal to another lower predetermined potential level, respectively, upon glow plug energization and subsequent deenergization, respectively.

Figure 2:
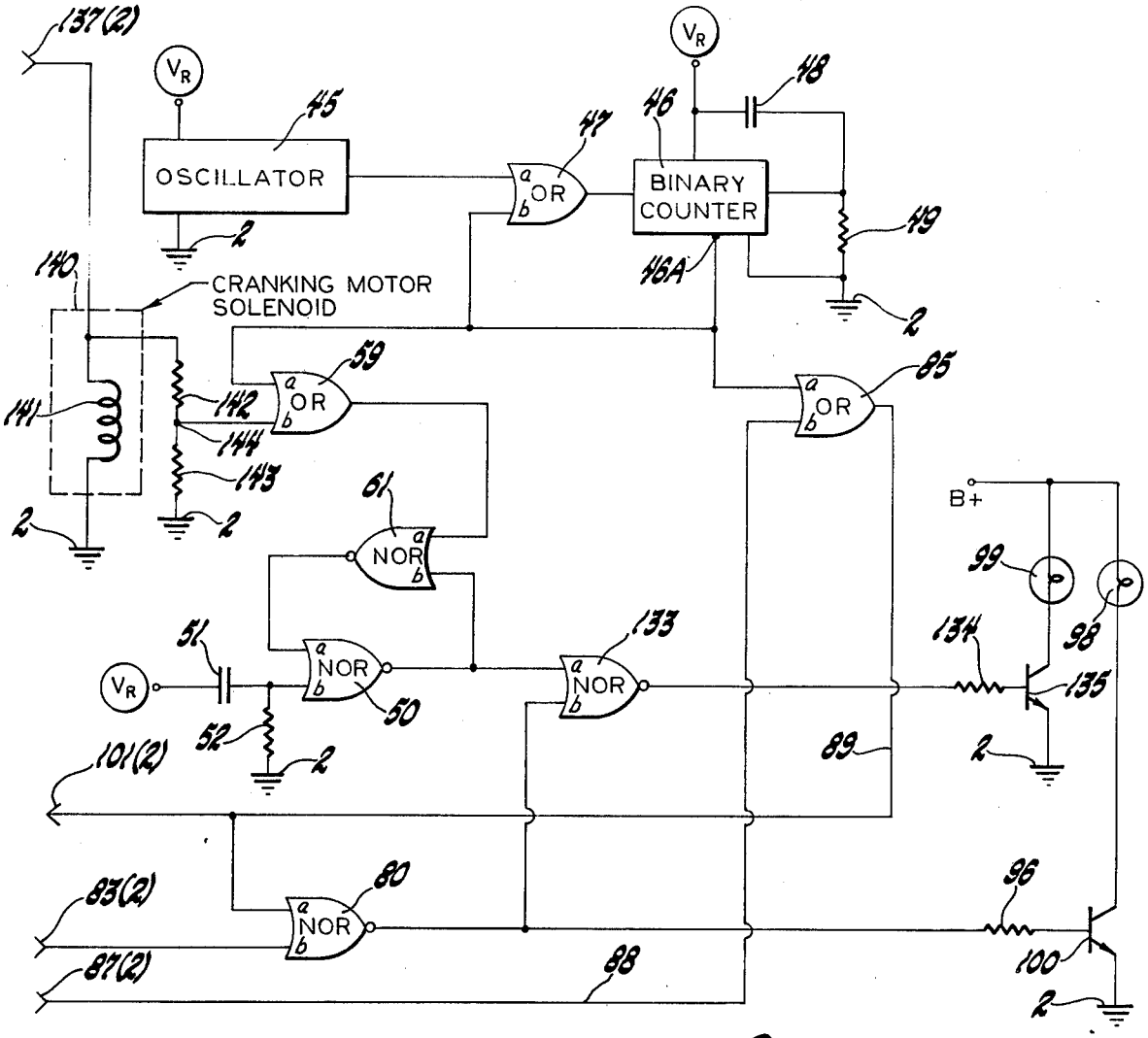
Figure 3:
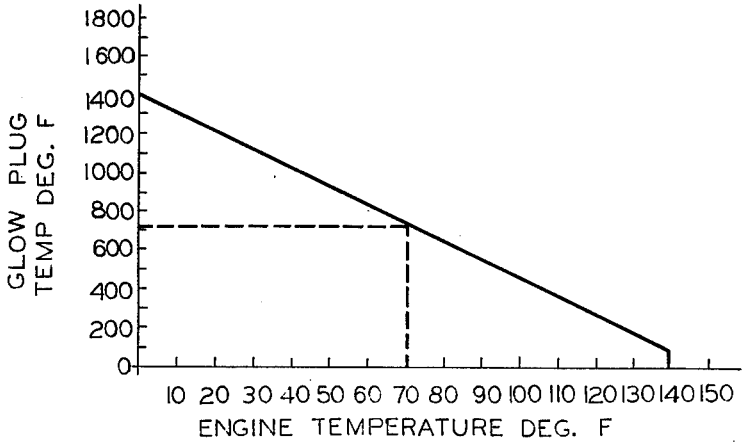

For a better understanding of the present invention, together with additional objects, advantages and features thereof, reference is made to the following description and accompanying drawing in which:

FIG. 1 sets forth in schematic form a portion of the Diesel engine glow plug energization control circuit of this invention;

FIG. 2 sets forth in schematic form the remainder of the Diesel engine glow plug energization control circuit of this invention; and FIG. 3 is a curve useful in the understanding of the circuit of FIGS. 1 and 2.

The Diesel engine glow plug energization control circuit of this invention employs conventional operational amplifier circuits, voltage comparator circuits, OR gates, NOR gates, and a conventional binary counter. As these circuit elements may be commercially available items well known in the art, and per se, form no part of this invention, each has been illustrated in block form in the drawing. Furthermore, these devices are only examples of circuit elements suitable for use with the circuit of this invention, consequently, there is no intention or inference of a limitation thereto as other circuit elements having similar electrical characteristics may be substituted therefor without departing from the spirit of the invention. The operational amplifier and voltage comparator circuits may be of the type marketed by National Semiconductor Corporation under the designations LM 2902 and LM 2901, respectively, and the OR gates, the NOR gates, and the binary counter may be of the type marketed by Motorola, Inc. under the designations MC 14570 AL, MC 14001 AL and MC 14020 AL, respectively.

In accordance with logic terminology well known in the art, throughout this specification logic signals will be referred to as "high" or logic 1 and "low" or logic 0 signals. For purposes of this specification, and without intention or inference of a limitation thereto, the "high" or logic 1 signals will be considered to be of a positive polarity potential and the "low" or logic 0 signals will be considered to be of zero or ground potential.

As point of reference, or ground potential is the same electrically throughout the circuit, it has been represented in the drawing by the accepted schematic symbol and referenced by the numeral 2.

Referring to FIGS. 1 and 2 of the drawing, the Diesel engine glow plug energization control circuit of this invention is set forth in schematic form in combination with a circuit operating potential source, which may be a conventional automotive type storage battery 3, and a Diesel engine 4. The Diesel engine 4 is indicated as having four glow plugs 1G, 2G, 3G and 4G connected in parallel, each corresponding to a respective engine 4 combustion chamber. For purposes of this specification, the Diesel engine glow plug energization control circuit of this invention will be described with regard to a four cylinder Diesel engine. It is to be specifically understood, however, that this circuit is also applicable to Diesel engines having more or less cylinders.

Engine 4 is arranged to drive a conventional automotive type alternator 5 in a manner well known in the art. The three phase output potential of alternator 5 is full-wave rectified by a conventional six diode bridge type full-wave rectifier circuit 6 having a positive polarity output terminal connected to the positive polarity output terminal of battery 3 and a negative polarity output terminal connected to point of reference or ground potential 2.

The positive polarity output terminal of battery 3 is connected to the movable contact *7m* of a conventional automotive type ignition switch 7 having in addition to movable contact *7m* two stationary contacts *7a* and *7b*. Ignition switch 7 may be a conventional automotive type ignition switch having an "Off" position, in which position it is shown in FIG. 1, a "Crank" position in which movable contact *7m* is in electrical contact with both stationary contacts *7a* and *7b* and a "Run" position in which movable contact *7m* is in electrical contact with stationary contact *7a*. Ignition switches of this type are normally spring biased to automatically return to the "Run" position from the "Crank" position upon the release of torque upon the ignition key, in a manner well known in the automotive art. Alternatively, switch 7 may be any other suitable electrical switch.

In the interest of reducing drawing complexity, specific operating potential connections to the circuit elements of FIGS. 1 and 2 have not been shown. It is to be specifically understood, however, that upon the closure of movable contact *7m* of ignition switch 7 to stationary contact *7a*, operating potential is supplied to the circuit elements of FIGS. 1 and 2 as required.

Associated with full-wave rectifier circuit 6 is a diode trio *6a*, *6b* and *6c* which provides the energizing current for alternator field winding 5FW through the current carrying electrodes of an NPN switching transistor 10 while this device is in the conductive mode. The circuitry including NPN switching transistor 10, control NPN transistor 11, resistors 12, 13, 14 and 15, diode 16, Zener diode 17 and filter capacitor 18 is a conventional voltage regulator circuit of a type well known in the automotive art. Briefly, while the output potential of rectifier circuit 6 is less than a predetermined magnitude, Zener diode 17 remains in the blocking state to maintain NPN control transistor 11 not conductive through the current carrying electrodes thereof. While NPN control transistor 11 is not conductive, the potential across resistor 14 is of a magnitude sufficient to trigger NPN switching transistor 10 conductive through the collector-emitter electrodes to complete an energizing circuit for field winding 5FW of alternator 5. Should the output potential of rectifier circuit 6 increase to a level substantially equal to or greater than the predetermined magnitude, Zener diode 17 breaks down and conducts in a reverse direction to trigger NPN control transistor 11 conductive through the current carrying electrodes thereof. While NPN control transistor 11 is conductive, base-emitter drive current is diverted from NPN switching transistor 10 to render this device not conductive, a condition which interrupts the alternator field coil 5FW energizing circuit.

Upon the operation of movable contact *7m* of ignition switch 7 into electrical circuit engagement with stationary contact *7a*, battery 3 potential appears across positive polarity potential lead 20 and point of reference or ground potential 2 and is of a positive polarity upon lead 20 with respect to point of reference or ground potential 2. Battery 3 output potential is regulated to a substantially constant regulated potential $V_R$ by a conventional voltage regulator circuit 21 which, since it may be any of the conventional voltage regulator circuits well known in the art, and, per se, forms no part of this invention is illustrated in FIG. 1 in block form. In an actual embodiment of the circuit of this invention, $V_R$ is of a potential level of 5.0 volts direct current. The regulated potential $V_R$ is applied to all points of the circuit in FIGS. 1 and 2 labeled $V_R$. The direct electrical connections between the output terminal of voltage regulator circuit 21 and these several points are not shown in the drawing in the interest of reducing drawing complexity. As is well known in the Diesel engine art, the temperature to which the glow plug or plugs should be heated before the engine should be cranked is determined by engine temperature. Hereafter in this specification, the temperature to which the glow plug or plugs should be heated before the engine should be cranked is referred to as the, "desired glow plug temperature".

In the actual embodiment of the Diesel engine glow plug energization control circuit of this invention, the desired glow plug temperature was empirically determined for the engine with which the circuit is used for a plurality of different engine temperatures. A plot of the data thus obtained is shown in FIG. 3 where engine temperature in degrees Fahrenheit is plotted against desired glow plug temperature in degrees Fahrenheit. The curve of FIG. 3 indicates that the desired glow plug temperature decreases substantially linearly with increases of engine temperature and that glow plug heating is not required with engine temperatures higher than 140° F. For example, with an engine temperature of 0° F., the desired glow plug temperature is 1400° F.

and with an engine temperature of 70° F., the desired glow plug temperature is 700° F.

In the actual embodiment, to substantially reduce the time required to heat the glow plugs to the desired glow plug temperature for any engine temperature less than 140° F., the parallel connected glow plugs are energized at twice rated energizing potential. Because the glow plugs are energized at twice rated energizing potential, it is necessary that the control circuit provide for the deenergization of the glow plug energizing circuit when the glow plugs have been heated to a maximum permissible temperature, 1800° F. with the glow plugs used in the actual embodiment, to prevent the destruction thereof by overheating. The control circuit of this invention, therefore, provides for the completion of a glow plug energizing circuit across the operating potential source in response to the application of operating potential and, thereafter, is effective to alternately interrupt and complete the glow plug energizing circuit in response to the increase of an electrical signal having an intstantaneous potential level indicative of glow plug temperature at that instant to a predetermined potential level indicative of the maximum glow plug temperature to which the glow plugs may be safely heated and in response to the decrease of this electrical signal to another lower predetermined potential level indicative of the desired glow plug temperature, respectively, upon glow plug energization and subsequent deenergization, respectively. The control circuit of this invention, therefore, is effective to cyclically interrupt and complete the glow plug energizing circuit when the glow plugs have been heated upon energization to the maximum glow plug temperature and when the glow plugs have cooled upon subsequent deenergization to the desired glow plug temperature, respectively.

To produce the electrical signal having an instantaneous potential level indicative of glow plug temperature at that instant, a glow plug temperature simulator circuit energized by the operating potential source, battery 3, is provided. This circuit includes the parallel connected combination of series connected resistor 25 and Zener diode 26, resistor 27 and series connected resistor 28 and Zener diode 29; resistor 30; input resistor 32; a conventional operational amplifier circuit 35 having associated feedback and input resistors 33 and 34, respectively; diode 36; resistors 37 and 38 and capacitor 40. As is well known in the art, upon energization, the rate of increase of glow plug temperature is a function of the direct current power applied thereto. The parallel combination of series connected resistor 25 and Zener diode 26, resistor 27 and series connected resistor 28 and Zener diode 29 and series resistor 30 are effective to produce upon junction 31 a direct current potential level which is a function of the square of the energizing potential applied across parallel connected glow plugs 1G, 2G, 3G and 4G as this circuitry is connected directly across the parallel connected engine glow plug combination through leads 41 and 42. With this arrangement, the potential applied across the circuitry just described is precisely equal to the energizing potential applied across the parallel connected glow plug combination. With glow plug energizing potential levels less than the inverse breakdown potential of Zener diodes 26 and 29, the potential upon junction 31 across resistor 30 is a function of the relative resistance values of resistor 27 and resistor 30; with glow plug energizing potential levels greater than the inverse breakdown potential of Zener diode 29 but less than the inverse breakdown potential of Zener diode 26, the potential upon junction 31 across resistor 30 is a function of the relative resistance values of the parallel combination of resistor 27 and series connected resistor 28 and Zener diode 29 and series resistor 30 and with glow plug energization potential levels greater than the inverse breakdown potential of Zener diodes 26 and 29, the potential upon junction 31 is a function of the relative resistance values of the parallel combination of series connected resistor 25 and Zener diode 26, resistor 27 and series connected resistor 28 and Zener diode 29 and series resistor 30. This circuit network, therefore, produces a signal upon junction 31 which is a function of the square of the glow plug energizing potential level. In the actual embodiment, resistor 25 is 510 ohms, resistor 27 is 3.3 kilohms, resistor 28 is 1.1 kilohms, resistor 30 is 200 ohms, Zener diode 29 has an inverse breakdown potential of 6.2 volts and Zener diode 26 has an inverse breakdown potential of 12 volts. The signal upon junction 31 is applied through input resistor 32 to the non-inverting input terminal of operational amplifier circuit 35 which amplifies this signal to a usable level. In the actual embodiment, the operational amplifier circuit corresponding to operational amplifier circuit 35 has a gain of 4. The output signal of operational amplifier circuit 35 is applied through diode 36 and resistor 37 across capacitor 40. The rates of increase and decrease of glow plug temperature are empirically determined and the resistance and capacitance values of resistor 37 and capacitor 40, respectively, are selected relative to each other to provide, during each charge cycle, a rate of increase of potential level across capacitor 40 that substantially corresponds to the empirically determined rate of increase of glow plug temperature and the resistance value of resistor 38 is selected relative to the capacitance value of capacitor 40 to provide, during each discharge cycle, a rate of decrease of potential level across capacitor 40 that substantially corresponds to the empirically determined rate of decrease of glow plug temperature. Consequently, the glow plug temperature simulator circuit produces an electrical signal upon junction 39 having a rate of increase of potential level substantially corresponding to the rate of increase of glow plug temperature and a rate of decrease of potential level substantially corresponding to the rate of decrease of glow plug temperature upon glow plug energization and subsequent deenergization, respectively. The instantaneous potential level of the electrical signal upon junction 39, therefore, is indicative of glow plug temperature at that instant.

Referring to FIG. 2, a timing system including an oscillator circuit 45 and a binary counter circuit 46 having the respective output and input terminals thereof interconnected through a conventional two input OR gate 47 is provided. As oscillator circuit 45 may be any of the many oscillator circuits well known in the art and binary counter circuit 46 may be any of the many commercially available binary counter circuits well known in the art and since neither, per se, forms a part of this invention, each has been illustrated in FIG. 2 in block form. The purpose of this timing system is to provide for the termination of glow plug heating at the conclusion of a predetermined period of time after movable contact *7m* of ignition switch 7 has been closed to stationary contact *7a* which, in the actual embodiment, is approximately two minutes. Assuming for purposes of this specification, and without intention or inference of a limitation thereto, that binary counter circuit 46 is a 14 stage binary counter, a logic 1 signal appears upon the $2^{14}$ output terminal 46A thereof upon a count of 16,384 oscillator circuit 45 output pulses. Therefore, for binary counter circuit 46 to count 16,384 oscillator circuit 45 output pulses in two minutes, the output pulse frequency of oscillator circuit 45 is 136.5 cycles per second.

Upon the closure of movable contact *7m* of ignition switch 7 into electrical circuit engagement with stationary contact *7a*, operating potential is applied to the circuit as substantially battery 3 potential appears across positive polarity potential lead 20 and point of reference or ground reference 2 and the regulated potential $V_R$, which is applied to all of the circuit points of FIGS. 1 and 2 labeled $V_R$, is present upon the output terminal of voltage regulator circuit 21. Referring to FIG. 2, the regulated potential $V_R$ (1) energizes oscillator circuit 45 and binary counter circuit 46, (2) is differentiated by capacitor 48 and resistor 49 and applied as a logic 1 reset signal pulse to binary counter circuit 46 to reset binary counter circuit 46 to zero, (3) is differentiated by capacitor 51 and resistor 52 and applied as a logic 1 signal pulse to input terminal b of conventional two input NOR gate 50 which, in response thereto, produces a logic 0 output signal and, referring to FIG. 1, (4) is applied across series resistors 53 and 54 and (5) series resistors 56 and 57. Referring to FIG. 2, as the engine is not being cranked at this time and since binary counter circuit 46 has not counted 16,384 oscillator circuit 45 output pulses, a logic 0 signal is applied to both input terminals a and b of conventional two input OR gate 59. In response to these logic 0 input signals, OR gate 59 produces a logic 0 output signal which is applied to input terminal a of conventional two input NOR gate 61. In response to this logic 0 signal upon input terminal a and the previously described NOR gate 50 logic 0 output signal applied to input terminal b thereof, NOR gate 61 produces a logic 1 output signal which is applied to input terminal a of NOR gate 50 to maintain a logic 0 signal upon the output terminal thereof. The initialization circuit comprising NOR gates 50 and 61, therefore, is reset upon the closure of movable contact *7m* of ignition switch 7 to stationary contact *7a*.

Referring to FIG. 1, a negative temperature coefficient thermistor 60 is mounted upon engine 4 at a location, such as the coolant jacket, at which it accurately senses engine temperature. The regulated potential $V_R$ is applied across series connected resistors 53 and 54 and the junction 55 therebetween is connected to thermistor 60. As thermistor 60 is of the negative temperature coefficient type, the resistance value thereof is inversely proportional to engine temperature. That is, as the engine temperature increases, the resistance value of thermistor 60 decreases. The resistance value of resistor 54 is selected relative to the resistance value curve of thermistor 60 such that, with the regulated potential $V_R$ applied across series resistors 53 and 54, the electrical signal upon junction 55 therebetween, which is equal to the potential drop across the parallel combination of thermistor 60 and resistor 54, is of a direct current potential level indicative of engine temperature. This signal, of a positive polarity potential with respect to point of reference or ground potential 2, is applied to the noninverting input terminal of a conventional operational amplifier circuit 67 having associated feedback and input resistors 68 and 69, respectively, which amplifies this signal to a usable level. In the actual embodiment, the operational amplifier circuit corresponding to operational amplifier circuit 67 has a gain of 2. The output signal of operational amplifier circuit 67 appears across junction 65 and point of reference or ground potential 2 and is applied (1) through the collector-emitter electrodes of NPN transistor 70 while this device is in the conductive mode, as will be later explained, across series connected resistors 71 and 72; (2) across series connected resistors 76 and 77 and (3) through input resistor 74 to the inverting input terminal of a conventional voltage comparator circuit 79.

The signal appearing upon junction 78 between series resistors 76 and 77 that is produced as a result of the signal upon junction 65 being applied across resistors 76 and 77 is applied to the inverting input terminal of conventional voltage comparator circuit 81. As the glow plugs are cold, the signal upon junction 39 is of a lower potential magnitude than the signal upon junction 78. Consequently, in response to the input signal from junction 78, voltage comparator circuit 81 produces a logic 0 output signal which is applied through resistor 82, circuit point 83(1) of FIG. 1 and circuit point 83(2) of FIG. 2 to input terminal b of conventional two input NOR gate 80.

The resistance values of series resistors 56 and 57 of FIG. 1 are so proportioned relative to each other that, with the regulated potential $V_R$ applied thereacross, the signal upon junction 58 therebetween is of a potential level indicative of the engine temperature above which glow plug energization is not required, 140° F. in the actual embodiment. Assuming for purposes of this specification that the engine temperature is 70° F., the potential level of the signal present upon junction 58, which is applied to the non-inverting input terminal of voltage comparator circuit 79, is less than that of the signal present upon junction 65 which is applied through resistor 74 to the inverting input terminal of voltage comparator circuit 79. Consequently, voltage comparator circuit 79 produces a logic 0 output signal which is applied through resistor 86 and circuit point 87(1) of FIG. 1 and circuit point 87(2) of FIG. 2 and lead 88 to input terminal b of a conventional two input OR gate 85. As binary counter circuit 46 has not completed counting 16,384 oscillator circuit 45 output signal pulses, a logic 0 signal is present upon the output terminal 46A thereof which is applied to input terminal a of OR gate 85. Consequently, OR gate 85 produces a logic 0 output signal which is applied through lead 89 to input terminal a of NOR gate 80. In response to a logic 0 signal upon both input terminals thereof, NOR gate 80 produces a logic 1 output signal which is applied through resistor 96 to the base electrode of NPN transistor 100 in the proper polarity relationship to produce base-emitter drive current through an NPN transistor. As the collector electrode of NPN transistor 100 is connected to the positive polarity output terminal of battery 3 through an electric "Wait" indicator lamp 98, NPN transistor 100 is triggered conductive through the collector-emitter electrodes to complete an energizing circuit for "Wait" indicator lamp 98 across battery 3. Upon being energized, "Wait" indicator lamp 98, which is mounted in the passenger compartment, illuminates to indicate that the glow plugs have not yet been heated to the desired glow plug temperature. The electrical connection between "Wait" indicator lamp 98 and the positive polarity output terminal of battery 3 has not been shown in the drawing in the interest of reducing drawing complexity. It is to be specifically understood, however, that the circuit point labeled B+ is connected through an appropriate lead to the positive polarity output terminal of battery 3, as is well known in the automotive art.

Simultaneously, battery 3 potential is applied through resistor 92, FIG. 1, across the base-emitter electrodes of NPN transistor 70 in the proper polarity relationship to produce base-emitter drive current through an NPN transistor. As the signal upon junction 65 is of a positive polarity, NPN transistor 70 is triggered conductive through the collector-emitter electrodes thereof to complete a circuit from junction 65 through series resistors 71 and 72 to point of reference or ground potential 2. The resistance values of resistors 71 and 72 are so proportioned relative to each other that, while NPN transistor 70 is conductive through the collector-emitter electrodes, the electrical signal upon junction 75 is of a direct current potential level indicative of the desired glow plug temperature, 700° F. for an engine temperature of 70° F. as indicated by FIG. 3, which is applied to the non-inverting input terminal of conventional voltage comparator circuit 90. As the signal upon the inverting input terminal of voltage comparator circuit 90 is of a potential level lower than that of the signal applied to the non-inverting input terminal thereof, voltage comparator circuit 90 produces a logic 1 output signal which is applied through resistor 91 to the base electrode of an NPN transistor Darlington pair 105. As has been previously explained, a logic 0 signal is present upon the output terminal of OR gate 85 of FIG. 2. This logic 0 signal is applied through lead 89 and circuit point 101(2) of FIG. 2 and circuit point 101(1) of FIG. 1 and input resistor 102 across the base-emitter electrodes of NPN transistor 110. As this logic 0 signal is incapable of providing base-emitter drive current to NPN transistor 110, this device is not conductive. With transistor 110 not conducting, the logic 1 output signal of voltage comparator circuit 90 triggers NPN transistor Darlington pair 105 conductive through the collector-emitter electrodes to complete a circuit through which current flows from positive polarity potential lead 20 through series resistors 111 and 112 to the negative polarity output terminal of battery 3 through point of reference or ground potential 2. The potential drop across resistor 111, which is of a positive polarity upon junction 116 with respect to junction 117, produces emitter-base drive current through PNP transistor 120. This emitter-base drive current triggers PNP transistor 120 conductive through the emitter-collector electrodes thereof to complete an energizing circuit for operating coil 124 of glow plug energizing circuit relay 125 from positive polarity potential lead 20, through the emitter-collector electrodes of PNP transistor 120, operating coil 124 and point of reference or ground potential 2 to the negative polarity output terminal of battery 3. Upon the energization of operating coil 124, movable contact 126 is operated into electrical circuit engagement with stationary contact 127. Upon the closure of movable contact 126 of relay 125 to stationary contact 127, (1) an energizing circuit is completed for the engine glow plugs which may be traced from the positive polarity terminal of battery 3, through leads 128 and 129, the closed contacts of relay 125, lead 42, the four parallel connected engine glow plugs 1G, 2G, 3G and 4G and point of reference or ground potential 2 to the negative polarity terminal of battery 3; (2) a potential signal of a substantially constant potential level equal to the sum of the value of the regulated potential $V_R$ and the potential drop across diode 93 appears upon junction 95, in a manner to be later explained; (3) battery potential is applied across the parallel combination of series connected resistor 25 and Zener diode 26, resistor 27 and series connected resistor 28 and Zener diode 29; and (4) battery potential is applied through resistor 131 across the base-emitter electrodes of NPN transistor 130 in the proper polarity relationship to produce base-emitter drive current through an NPN transistor.

The base-emitter drive current supplied through resistor 131 to NPN transistor 130 triggers this device conductive through the collector-emitter electrodes thereof to divert base drive current from NPN transistor 70 to render transistor 70 not conductive. With transistor 70 not conducting, the circuit previously described through which current flows from junction 65 through series resistors 71 and 72 is interrupted. Upon the interruption of this circuit, the potential upon junction 95 is applied across the voltage divider network made up of series resistors 62 and 72. While contacts 126 and 127 of glow plug energizing circuit relay 125 are closed, diode 93 connected across junction 95 between series resistors 63 and 62 and the output terminal of voltage regulator circuit 21 clamps the potential of the signal upon the junction 95 at a level equal to the level of the regulated potential $V_R$ plus the drop across diode 93. In the actual embodiment, the diode corresponding to diode 93 has a potential drop thereacross of 0.6 volts, consequently, the potential level of the signal present upon junction 95 is clamped at 5.6 volts direct current. The resistance values of series resistors 62 and 72 are so selected relative to each other that, with the potential signal present upon junction 95 applied thereacross while NPN transistor 70 is not conductive, the electrical signal appearing upon junction 75 is of a direct current potential level indicative of the maximum glow plug temperature to which the glow plugs may be heated, 1800° F. in the actual embodiment. The two discrete signals that appear upon junction 75, one of which is indicative of desired glow plug temperature and the other of which is indicative of maximum glow plug temperature, are mutually exclusive. While the contacts 126 and 127 of the glow plug energizing circuit relay 125 are open, transistor 70 is conductive and the signal indicative of desired glow plug temperature is present upon junction 75. While the contcts 126 and 127 of the glow plug energizing circuit relay 125 are closed, transistor 70 is not conductive and the signal indicative of maximum glow plug temperature is present upon junction 75.

Simultaneously, the electrical signal which is a function of the square of the output potential level of the operating potential source, battery 3, appears upon junction 31 as previously explained. This signal is amplified to a usable level by operational amplifier 35 and begins to charge capacitor 40 through the series combination of diode 36 and resistor 37. As has been previously brought out, the respective resistance and capacitance values of resistor 37 and capacitor 40 are so proportioned relative to each other that the signal upon junction 39 increases in potential level at a rate substantially corresponding to the rate of increase of glow plug temperature and is applied to the inverting input terminal of voltage comparator circuit 90 and through lead 132 to the non-inverting input terminal of voltage comparator circuit 81. When the signal present upon junction 39 has increased to a potential level indicative of the desired glow plug temperature, the potential level of this signal becomes greater than that of the amplified engine temperature indicating signal upon junction 65, consequently, voltage comparator circuit 81 switches to the condition in which a logic 1 output signal is present upon the output terminal thereof. This logic 1 output signal is applied through resistor 82 and circuit point 83(1) of FIG. 1 and circuit point 83(2) of FIG. 2 to input terminal b of NOR gate 80. In response to this logic 1 signal upon input terminal b thereof, NOR gate 80 produces a logic 0 output signal. As this logic 0 output signal does not supply base-emitter drive current to NPN transistor 100, this device goes not conductive to interrupt the circuit through which "Wait" lamp 98 is energized. The logic 0 output signal of NOR gate 80 is also applied to input terminal b of conventional NOR gate 133, which also has a logic 0 signal present upon input terminal a thereof from NOR gate 50. In response to these two logic 0 signals, NOR gate 133 produces a logic 1 output signal which is applied through resistor 134 across the base-emitter electrodes of NPN transistor 135 and the proper polarity relationship to produce base-emitter drive current through an NPN transistor. As the collector electrode of NPN transistor 135 is connected to the positive polarity output terminal of battery 3 through an electric "Crank" indicator lamp 99, NPN transistor 135 is triggered conductive through the collector-emitter electrodes to complete an energizing circuit for "Crank" indicator lamp 99 across battery 3. Upon being energized, "Crank" indicator lamp 99, also mounted in the passenger compartment, illuminates to indicate that the engine may be cranked. As with the "Wait" indicator lamp 98, in the interest of reducing drawing complexity, the electrical connection between "Crank" indicator lamp 99 and the positive polarity output terminal of battery 3 has not been shown.

Assuming that the engine is cranked upon the energization of "Crank" indicator lamp 98, movable contact *7m* of ignition switch 7, FIG. 1, is closed into electrical circuit engagement with stationary contact *7b* to complete an energizing circuit for cranking motor solenoid 140, FIG. 2, which may be traced from the positive polarity output terminal of battery 3, through closed contacts *7m* and *7b* of ignition switch 7, lead 136, circuit point 137(1) of FIG. 1, circuit point 137(2) of FIG. 2, operating coil 141 of cranking motor solenoid 140 and point of reference or ground potential 2 to the negative polarity terminal of battery 3. Upon the completion of this energizing circuit, battery 3 potential is also applied across the voltage divider network consisting of series connected resistors 142 and 143. As a result of current flow through these two series connected resistors, a logic 1 signal is present upon junction 144 which is applied to input terminal b of OR gate 59. In response to this logic 1 input signal, OR gate 59 produces a logic 1 output signal which is applied to input terminal a of NOR gate 61. In response to this logic 1 input signal, NOR gate 61 produces a logic 0 output signal which is applied to input terminal a of NOR gate 50. In response to this logic 0 signal and the logic 0 signal present upon input terminal b thereof, NOR gate 50 produces a logic 1 output signal which is applied to input terminal a of NOR gate 133. In response to this logic 1 signal, NOR gate 133 produces a logic 0 output signal. As this logic 0 signal does not supply base-emitter drive current to NPN transistor 135, this device goes not conductive to interrupt the cicuit through which the "Crank" indicator is energized. The "Crank" indicator lamp energizing circuit is maintained locked out until the initialization circuit comprising NOR gate 61 is reset in a manner previously explained as the NOR gate 50 logic 1 output signal is maintained.

In the meantime, the engine glow plugs continue to be energized, consequently, the electrical signal upon junction 39 of FIG. 1 continues to increase in potential level at a rate substantially corresponding to the rate of increase of glow plug temperature. When the potential level of this signal reaches a magnitude substantially equal to that of the signal upon junction 75 which is indicative of the maximum glow plug temperature to which the glow plugs may be safely heated, comparator cicuit 90 switches to the state in which a logic 0 signal is present upon the output terminal thereof. As this logic 0 output signal does not supply base-emitter drive current to the NPN transistor Darlington pair 105, this device is rendered not conductive to interrupt the circuit through which emitter-base drive current is supplied to PNP transistor 120, a condition which renders PNP transistor 120 not conductive. With PNP transistor 120 in the not conducting mode, the previously described energizing circuit for operating coil 124 of glow plug energizing circuit relay 125 is interrupted, consequently, movable contact 126 is spring bias operated out of electrical circuit engagement with stationary contact 127. Upon this operation, the circuit through which the engine glow plugs and the parallel combination of series connected resistor 25 and Zener diode 26, resistor 27 and series connected resistor 28 and Zener diode 29 are energized is interrupted, the electrical signal is removed from junction 95 and the circuit through which base-emitter drive current is supplied to NPN transistor 130 is interrupted to render this device not conductive. With NPN transistor 130 not conducting, base-emitter drive current is supplied to NPN transistor 70 through a circuit previously described to trigger this device conductive, consequently, the electrical signal indicative of desired glow plug temperature is again present upon junction 75.

As the glow plug energizing circuit is interrupted, the glow plugs begin to cool off and capacitor 40 begins to discharge through resistor 38, being prevented from discharging through resistors 37, 33, and 34 by diode 36. As the resistance and capacitance values of resistor 38 and capacitor 40 are so selected relative to each other that capacitor 40 discharges at a rate substantially corresponding to the rate of decrease of glow plug temperature, the signal present upon junction 39 decreases in potential level at a rate substantially corresponding to the rate of decrease of glow plug temperature. When the potential level of the signal present upon junction 39 has decreased to a level substantially equal to that of the signal indicative of desired glow plug temperature present upon junction 75, comparator circuit 90 switches to the state in which a logic 1 signal is present upon the output terminal thereof which triggers NPN transistor Darlington pair 105 conductive. Upon the conduction of the NPN transistor Darlington pair 105, the circuit previously described through which operating coil 124 of glow plug energizing circuit relay 125 is energized is established. Upon the completion of this circuit, movable contact 126 is operated into electrical circuit engagement with stationary contact 127. Upon the closure of these contacts, the cycle of events previously described are repeated.

From this description, it is apparent that the glow plug energizing circuit is completed in response to the application of operating potential and, thereafter, is alternately interrupted and completed in response to the increase of the potential of the electrical signal present upon junction 39 to a level substantially equal to that of the electrical signal that is present upon junction 75 while the glow plug energizing circuit is completed and is indicative of maximum glow plug temperature and in response to the decrease of the potential of the electrical signal present upon junction 39 to another lower level substantially equal to that of the electrical signal that is present upon junction 75 while the glow plug energizing circuit is interrupted and is indicative of the desired glow plug temperature, respectively, whereby the glow plug energizing circuit is cyclically completed and interrupted.

When the timing circuit including oscillator circuit 45, OR gate 47 and binary counter circuit 46 has timed out at the end of approximately two minutes, a logic 1 signal appears upon output terminal 46A of binary counter circuit 46. This logic 1 signal is applied to input terminal a of OR gate 85, to input terminal b of OR gate 47 and to input terminal a of OR gate 59. With a logic 1 signal applied to input terminal b thereof, OR gate 47 prevents the further gating of oscillator circuit 45 output signal pulses therethrough to binary counter circuit 46, and in response to this logic 1 signal, OR gates 59 and 85 each produce a logic 1 output signal. The logic 1 output signal of OR gate 59 is applied to input terminal a of NOR gate 61. However, since a logic 1 signal is already present upon input terminal b thereof, the output signal of NOR gate 61 remains a logic 0. The logic 1 output signal of OR gate 85 is applied through lead 89 and circuit point 101(2) of FIG. 2 and circuit point 101(1) of FIG. 1 and resistor 102 across the base-emitter electrodes of NPN transistor 110 in the proper polarity relationship to produce base-emitter drive current through an NPN transistor. This base-emitter drive current conditions NPN transistor 110 for collector-emitter conduction the next time the output signal of voltage comparator circuit 90 becomes a logic 1. When voltage comparator circuit 90 produces a logic 1 output signal, NPN transistor 110 conducts through the collector-emitter electrodes thereof to divert base-emitter drive current from the NPN transistor Darlington pair 105 to maintain this device not conductive and, therefore, the previously described energizing circuit for operating coil 124 of glow plug energizing circuit relay 125 deenergized. Consequently, the circuit is maintained in this inoperative state until operating potential is removed therefrom and later reapplied.

Upon the application of operating potential when the temperature of engine 4 is 140° F. or greater, the potential signal present upon junction 65, which is the amplified signal indicative of engine temperature, is of a level lower than that of the signal upon junction 58, which is indicative of an engine temperature of 140° F. and NOR gate 50 produces a logic 0 output signal as previously explained. In response to the electrical signals present upon junctions 58 and 65, voltage comparator circuit 79 produces a logic 1 output signal which is applied through resistor 86 and circuit point 87(1) of FIG. 1 and circuit point 87(2) of FIG. 2 and lead 88 to input terminal b of OR gate 85. In response to this logic 1 input signal, OR gate 85 produces a logic 1 output signal which is applied through lead 89 and circuit point 101(2) of FIG. 2 and circuit point 101(1) of FIG. 1 and resistor 102 across the base-emitter electrodes of NPN transistor 110 in the proper polarity relationship to produce base-emitter drive current through an NPN transistor. This base-emitter drive current conditions NPN transistor 110 for collector-emitter conduction the next time the output signal of voltage comparator circuit 90 becomes a logic 1. When voltage comparator circuit 90 produces a logic 1 output signal, NPN transistor 110 conducts through the collector-emitter electrodes thereof to divert base-emitter drive current from the NPN transistor Darlington pair 105 to maintain this device not conductive and, therefore, the previously described energizing circuit for operating coil 124 of glow plug energizing circuit relay 125 deenergized. Consequently, the circuit is inoperative with engine temperature of 140° F. or higher. However, upon the initial application of operating potential, NOR gate 50 of FIG. 2 produces a logic 0 output signal, as previously described, which is applied to input terminal a of NOR gate 133. The logic 1 output signal of OR gate 85 is also applied to input terminal a of NOR gate 80. In response to this logic 1 input signal, NOR gate 80 produces a logic 0 output signal which is applied to input terminal b of NOR gate 133. In response to the logic 0 signal applied to input terminals a and b thereof, NOR gate 133 produces a logic 1 output signal which triggers NPN transistor 135 conductive through the collector-emitter electrodes to complete the previously described energizing circuit for "Crank" indicator lamp 99.

After the engine has started and is in the "Run" mode, an electrical signal of a positive polarity potential with respect to point of reference or ground potential 2 is present upon junction 150 of FIG. 1 and is of a level equal to the output potential level of rectifier circuit 6. This signal is applied across the emitter-base electrodes of PNP transistor 155 through resistor 151. Zener diode 156 is selected to have an inverse breakdown potential less than that of the potential level of the signal upon junction 150. Consequently, this device breaks down and conducts in the reverse direction when the potential level of the signal present upon juncton 150 exceeds the breakdown potential thereof. Resistor 157 estblishes a substantially constant Zener voltage. Upon this conduction of Zener diode 156, emitter-base drive current is supplied to PNP transistor 155 to trigger this device conductive through the emitter-collector electrodes. Upon the conduction of PNP transistor 155, current flows through series connected resistors 161 and 162 to produce an electrical potential signal upon junction 160. This signal is applied through diode 165 and resistor 166 across capacitor 40. The resistance value of resistor 166 is so selected relative to the capacitance value of capacitor 40 that the charge placed upon capacitor 40 as a result of the electrical signal upon junction 160 is of a potential level indicative of glow plug temperature as a result of engine heat of combustion while the engine is in the "Run" mode. For the remainder of the time required for the previously described timing circuit of FIG. 2 to time out, therefore, the signal present upon junction 39 while the glow plug energizing circuit is established increases in potential to a level equal to that of the signal present upon junction 75 in a shorter length of time than while the engine is not in the "Run" mode. This expedient is necessary to prevent the flow plugs from being overheated while the engine is in the "Run" mode during any portion of the timed period. The signal produced upon junction 160, therefore, prevents the electrical signal upon junction 39 from decreasing in potential level below the potential level indicative of glow plug temperature as a result of engine heat of combustion.

While a preferred embodiment of the present invention has been shown and described, it will be obvious to those skilled in the art that various modifications and substitutions may be made without departing from the spirit of the invention which is to be limited only within the scope of the appended claims.

What is claimed is:

1. A Diesel engine glow plug energization control circuit for use with Diesel engines having at least one glow plug comprising in combination with a circuit operating potential source; glow plug temperature simulator means energized by said operating potential source for producing an electrical signal having a rate of increase of potential level substantially corresponding to the rate of increase of glow plug temperature and a rate of decrease of potential level substantially corresponding to the rate of decrease of glow plug temperature upon glow plug energization and subsequent deenergization, respectively, whereby the instantaneous potential level of said electrical signal is indicative of glow plug temperature at that instant; and means effective to complete a glow plug energizing circuit across said operating potential source in response to the application of operating potential and, thereafter, being effective to alternately interrupt and complete said glow plug energizing circuit in response to the increase of said electrical signal to a predetermined potential level and in response to the decrease of said electrical signal to another lower predetermined potential level, respectively, whereby said glow plug energizing circuit is cyclically completed and interrupted.

2. A Diesel engine glow plug energization control circuit for use with Diesel engines having at least one glow plug comprising in combination with a circuit operating potential source; glow plug temperature simulator means energized by said operating potential source for producing an electrical signal having a rate of increase of potential level substantially corresponding to the rate of increase of glow plug temperature and a rate of decrease of potential level substantially corresponding to the rate of decrease of glow plug temperature upon glow plug energization and subsequent deenergization, respectively, whereby the instantaneous potential level of said electrical signal is indicative of glow plug temperature at that instant; means effective to complete a glow plug energizing circuit across said operating potential source in response to the application of operating potential and, thereafter, being effective to alternately interrupt and complete said glow plug energizing circuit in response to the increase of said electrical signal to a predetermined potential level and in response to the decrease of said electrical signal to another lower predetermined potential level, respectively, whereby said glow plug energizing circuit is cyclically completed and interrupted; and means for preventing said electrical signal from decreasing in potential level below a predetermined potential level indicative of glow plug temperature as a result of engine heat of combustion.

3. A Diesel engine glow plug energization control circuit for use with Diesel engines having at least one glow plug comprising in combination with a circuit operating potential source; means for producing a first electrical signal of a direct current potential level that is a function of the square of the output potential level of said operating potential source; means responsive to said first electrical signal for producing a second electrical signal having a rate of increase of potential level substantially corresponding to the rate of increase of glow plug temperature and a rate of decrease of potential level substantially corresponding to the rate of decrease of glow plug temperature upon glow plug energization and subsequent deenergization, respectively, whereby the instantaneous potential level of said second electrical signal is indicative of glow plug temperature at that instant; and means effective to complete a glow plug energizing circuit across said operating potential source in response to the application of operating potential and, thereafter, being effective to alternately interrupt and complete said glow plug energizing circuit in response to the increase of said second electrical signal to a predetermined potential level and in response to the decrease of said second electrical signal to another lower predetermined potential level, respectively, whereby said glow plug energizing circuit is cyclically completed and interrupted.

4. A Diesel engine glow plug energization control circuit for use with Diesel engines having at least one glow plug comprising in combination with a circuit operating potential source; means for producing a first electrical signal of a direct current potential level that is a function of the square of the output potential level of said operating potential source; means responsive to said first electrical signal for producing a second electrical signal having a rate of increase of potential level substantially corresponding to the rate of increase of glow plug temperature and a rate of decrease of potential level substantially corresponding to the rate of decrease of glow plug temperature upon glow plug energization and subsequent deenergization, respectively, whereby the instantaneous potential level of said second electrical signal is indicative of glow plug temperature at that instant; means effective to complete a glow plug energizing circuit across said operating potential source in response to the application of operating potential and, thereafter, being effective to alternately interrupt and complete said glow plug energizing circuit in response to the increase of said second electrical signal to a predetermined potential level and in response to the decrease of said second electrical signal to another lower predetermined potential level, respectively, whereby said glow plug energizing circuit is cyclically completed and interrupted; and means for preventing said second electrical signal from decreasing in potential level below a predetermined potential level indicative of glow plug temperature as a result of engine heat of combustion.

5. A Diesel engine glow plug energization control circuit for use with Diesel engines having at least one glow plug comprising in combination with a circuit operating potential source; means for producing a first electrical signal of a potential level indicative of desired glow plug temperature; glow plug temperature simulator means energized by said operating potential source for producing a second electrical signal having a rate of increase of potential level substantially corresponding to the rate of increase of glow plug temperature and a rate of decrease of potential level substantially corresponding to the rate of decrease of glow plug temperature when said glow plug energizing circuit is completed and interrupted, respectively, whereby the instantaneous potential level of said second electrical signal is indicative of glow plug temperature at that instant; and means effective to complete a glow plug energizing circuit across said operating potential source in response to the application of operating potential, and thereafter, being effective to alternately interrupt and complete said glow plug energizing circuit in response to the increase of said second electrical signal to a predetermined potential level and in response to the decrease of said second electrical signal to another lower potential level substantially equal to that of said first electrical signal, respectively, whereby said glow plug energizing circuit is cyclically completed and interrupted.

6. A Diesel engine glow plug energization control circuit for use with Diesel engines having at least one glow plug comprising in combination with a circuit operating potential source; means for producing a first electrical signal of a potential level indicative of desired glow plug temperature; glow plug temperature simulator means energized by said operating potential source for producing a second electrical signal having a rate of increase of potential level substantially corresponding to the rate of increase of glow plug temperature and a rate of decrease of potential level substantially corresponding to the rate of decrease of glow plug temperature when said glow plug energizing circuit is completed and interrupted, respectively, whereby the instantaneous potential level of said second electrical signal is indicative of glow plug temperature at that instant; means effective to complete a glow plug energizing circuit across said operating potential source in response to the application of operating potential and, thereafter, being effective to alternately interrupt and complete said glow plug energizing circuit in response to the increase of said second electrical signal to a predetermined potential level and in response to the decrease of said second electrical signal to another lower potential level substantially equal to that of said first electrical signal, respectively, whereby said glow plug energizing circuit is cyclically completed and interrupted; and means for preventing said second electrical signal from decreasing in potential level below a predetermined potential level indicative of glow plug temperature as a result of engine heat of combustion.

7. A Diesel engine glow plug energization control circuit for use with Diesel engines having at least one glow plug comprising in combination with a circuit operating potential source; an electrically operable electrical switching arrangement effective to complete a glow plug energizing circuit across said operating potential source and to interrupt said energizing circuit; means for producing, while said glow plug energizing circuit is interrupted, a first electrical signal of a potential level indicative of desired glow plug temperature; means for producing, while said glow plug energizing circuit is completed, a second electrical signal of a potential level indicative of maximum glow plug temperature; glow plug temperature simulator means energized by said operating potential source for producing a third electrical signal having a rate of increase of potential level substantially corresponding to the rate of increase of glow plug temperature and a rate of decrease of potential level substantially corresponding to the rate of decrease of glow plug temperature when said glow plug energizing circuit is completed and interrupted, respectively, whereby the instantaneous potential level of said third electrical signal is indicative of glow plug temperature at that instant; and means effective upon the application of circuit operating potential to operate said electrical switching arrangement to complete said glow plug energizing circuit in response to the combination of said first and third electrical signals and, thereafter, being effective to operate said electrical switching arrangement to interrupt said glow plug energizing circuit in response to the combination of said second and third electrical signals when the potential of said third electrical signal has increased to a level substantially equal to that of said second electrical signal and to operate said electrical switching arrangement to complete said glow plug energizing circuit in response to the combination of said first and third electrical signals when the potential of said third electrical signal has decreased to a level substantially equal to that of said first electrical signal whereby said glow plug energizing circuit is cyclically completed and interrupted.

8. A Diesel engine glow plug energization control circuit for use with Diesel engines having at least one glow plug comprising in combination with a circuit operating potential source; an electrically operable electrical switching arrangement effective to complete a glow plug energizing circuit across said operating potential source and to interrupt said energizing circuit; means for producing, while said glow plug energizing circuit is interrupted, a first electrical signal of a potential level indicative of desired glow plug temperature; means for producing, while said glow plug energizing circuit is completed, a second electrical signal of a potential level indicative of maximum glow plug temperature; means for producing, while said glow plug energizing circuit is completed, a third electrical signal of a direct current potential level that is a function of the square of the output potential level of said operating potential source; means responsive to said third electrical signal for producing a fourth electrical signal having a rate of increase of potential level substantially corresponding to the rate of increase of glow plug temperature and a rate of decrease of potential level substantially corresponding to the rate of decrease of glow plug temperature when said glow plug energizing circuit is completed and interrupted, respectively, whereby the instantaneous potential level of said fourth electrical signal is indicative of glow plug temperature at that instant; and means effective upon the application of circuit operating potential to operate said electrical switching arrangement to complete said glow plug energizing circuit in response to the combination of said first and fourth electrical signals and, thereafter, being effective to operate said electrical switching arrangement to interrupt said glow plug energizing circuit in response to the combination of said second and fourth electrical signals when the potential of said fourth electrical signal has increased to a level substantially equal to that of said second electrical signal and to operate said electrical switching arrangement to complete said glow plug energizing circuit in response to the combination of said first and fourth electrical signals when the potential of said fourth electrical signal has decreased to a level substantially equal to that of said first electrical signal whereby said glow plug energizing circuit is cyclically completed and interrupted.

9. A Diesel engine glow plug energization control circuit for use with Diesel engines having at least one glow plug comprising in combination with a circuit operating potential source; an electrically operable electrical switching arrangement effective to complete a glow plug energizing circuit across said operating potential source and to interrupt said energizing circuit; means for producing, while said glow plug energizing circuit is interrupted, a first electrical signal of a potential level indicative of desired glow plug temperature;

means for producing, while said glow plug energizing circuit is completed, a second electrical signal of a potential level indicative of maximum glow plug temperature; glow plug temperature simulator means energized by said operating potential source for producing a third electrical signal having a rate of increase of potential level substantially corresponding to the rate of increase of glow plug temperature and a rate of decrease of potential level substantially corresponding to the rate of decrease of glow plug temperature when said glow plug energizing circuit is completed and interrupted, respectively, whereby the instantaneous potential level of said third electrical signal is indicative of glow plug temperature at that instant; means effective upon the application of circuit operating potential to operate said electrical switching arrangement to complete said glow plug energizing circuit in response to the combination of said first and third electrical signals and, thereafter, being effective to operate said electrical switching arrangement to interrupt said glow plug energizing circuit in response to the combination of said second and third electrical signals when the potential of said third electrical signal has increased to a level substantially equal to that of said second electrical signal and to operate said electrical switching arrangement to complete said glow plug energizing circuit in response to the combination of said first and third electrical signals when the potential of said third electrical signal has decreased to a level substantially equal to that of said first electrical signal whereby said glow plug energizing circuit is cyclically completed and interrupted; and means for preventing said third electrical signal from decreasing in potential level below a predetermined potential level indicative of glow plug temperature as a result of engine heat of combustion.

10. A Diesel engine glow plug energization control circuit for use with Diesel engines having at least one glow plug comprising in combination with a circuit operating potential source; an electrically operable electrical switching arrangement effective to complete a glow plug energizing circuit across said operating potential source and to interrupt said energizing circuit; means for producing, while said glow plug energizing circuit is interrupted, a first electrical signal of a potential level indicative of desired glow plug temperature; means for producing, while said glow plug energizing circuit is completed, a second electrical signal of a potential level indicative of maximum glow plug temperature; means for producing, while said glow plug energizing circuit is completed, a third electrical signal of a direct current potential level that is a function of the square of the output potential level of said operating potential source; means responsive to said third electrical signal for producing a fourth electrical signal having a rate of increase of potential level substantially corresponding to the rate of increase of glow plug temperature and a rate of decrease of potential level substantially corresponding to the rate of decrease of glow plug temperature when said glow plug energizing circuit is completed and interrupted, respectively, whereby the instantaneous potential level of said fourth electrical signal is indicative of glow plug temperature at that instant; means effective upon the application of circuit operating potential to operate said electrical switching arrangement to complete said glow plug energizing circuit in response to the combination of said first and fourth electrical signals and, thereafter, being effective to operate said electrical switching arrangement to interrupt said glow plug energizing circuit in response to the combination of said second and fourth electrical signals when the potential of said fourth electrical signal has increased to a level substantially equal to that of said second electrical signal and to operate said electrical switching arrangement to complete said glow plug energizing circuit in response to the combination of said first and fourth electrical signals when the potential of said fourth electrical signal has decreased to a level substantially equal to that of said first electrical signal whereby said glow plug energizing circuit is cyclically completed and interrupted; and means for preventing said fourth electrical signal from decreasing in potential level below a predetermined potential level indicative of glow plug temperature as a result of engine heat of combustion.

* * * * *